US008027573B2

(12) United States Patent
Byrne

(10) Patent No.: US 8,027,573 B2
(45) Date of Patent: Sep. 27, 2011

(54) INTEGRATED LAMP AND HEATER ASSEMBLY

(76) Inventor: James Anthony Byrne, St. Petersburg, FL (US)

( * ) Notice: Subject to any disclaimer, the term of this patent is extended or adjusted under 35 U.S.C. 154(b) by 361 days.

(21) Appl. No.: 12/352,107

(22) Filed: Jan. 12, 2009

(65) Prior Publication Data

US 2009/0180767 A1 Jul. 16, 2009

Related U.S. Application Data

(60) Provisional application No. 61/020,327, filed on Jan. 10, 2008.

(51) Int. Cl.
*F24D 13/00* (2006.01)

(52) U.S. Cl. ..... 392/347; 392/360; 392/365; 392/373; 392/382

(58) Field of Classification Search ..... 392/347, 392/360, 365, 373, 382
See application file for complete search history.

(56) References Cited

U.S. PATENT DOCUMENTS

| | | | | |
|---|---|---|---|---|
| 1,337,560 | A * | 4/1920 | Kohn | 416/5 |
| 1,371,936 | A * | 3/1921 | Rubino | 416/5 |
| 1,889,567 | A * | 11/1932 | Persons | 415/121.3 |
| 4,665,472 | A * | 5/1987 | Chang | 362/294 |
| 4,974,126 | A * | 11/1990 | Hwang | 362/96 |
| 5,287,253 | A * | 2/1994 | Blorstad | 362/92 |
| 5,511,145 | A | 4/1996 | Bailey | |
| 5,603,562 | A * | 2/1997 | Huang | 362/96 |
| 5,668,920 | A * | 9/1997 | Pelonis | 392/361 |
| 6,089,726 | A | 7/2000 | Eldridge, Jr. | |
| 6,160,956 | A * | 12/2000 | Pelonis | 392/361 |
| 6,304,719 | B1 | 10/2001 | Mo | |
| 6,428,185 | B1 * | 8/2002 | Lin | 362/253 |
| 6,478,440 | B1 * | 11/2002 | Jaworski et al. | 362/96 |
| D500,567 | S * | 1/2005 | Henry | D26/59 |
| 7,147,336 | B1 * | 12/2006 | Chou | 362/96 |

* cited by examiner

*Primary Examiner* — Thor Campbell
(74) *Attorney, Agent, or Firm* — Brian S. Steinberger; Law Offices of Brian S. Steinberger, P.A.

(57) ABSTRACT

An integrated lamp and heater assembly comprises in one embodiment a table lamp and heater intended to be positioned on a table, such as an end table, coffee table, nightstand, or the like and in another embodiment a free-standing floor lamp and heater. The integrated lamp and heater assembly is intended to be positioned proximate to a chair, a bed or other area that is desirous of being illuminated and being provided with a supplemental flow of heated air.

12 Claims, 3 Drawing Sheets

FIG 2A
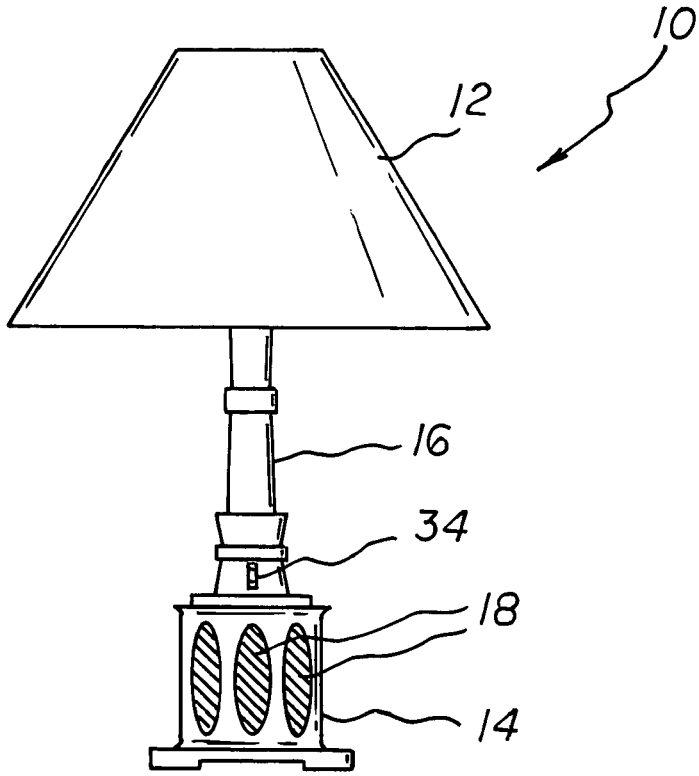
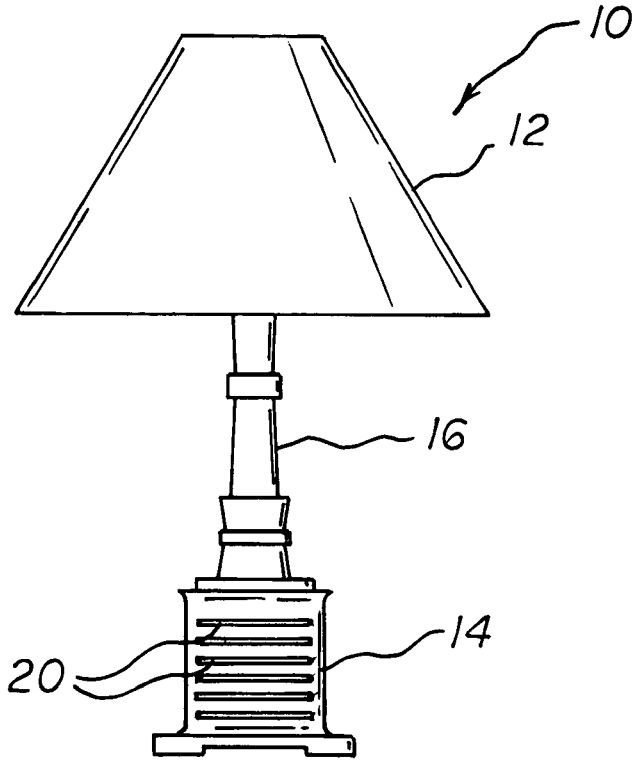
FIG 2B

INTEGRATED LAMP AND HEATER ASSEMBLY

CROSS-REFERENCE TO RELATED APPLICATIONS

This application claims the benefit of provisional patent application 61/020,327, filed Jan. 10, 2008, the disclosure of which is hereby incorporated by reference herein.

BACKGROUND OF THE INVENTION

1. Field of the Invention

This invention relates to lamps and heaters. More particularly, this invention relates to lamps which comprise an integrated heater for producing heated air flow to the surrounding area.

2. Description of the Background Art

Presently, there exist many types of lamps for illuminating an area. Household lamps typically comprise tabletop or floor lamps intended to be positioned proximate to a couch, a bed, or other comfort area such that the light emitted from the lamp provides illumination proximate to the comfort area where an occupant may be seated or lying and reading a book or a magazine. Unfortunately, however, these comfort areas often are not adjacent to a heating duct of the household's heating system. Consequently, the person may feel "cold" even when the household's heating system is set at a comfortable temperature. Indeed, the person's perception of feeling "cold" is enhanced inasmuch as the person is relaxing while reading a book or magazine and is not otherwise engaged in any physical activity.

Presently, there exist many types of space heaters, commonly portable in nature, designed to provide heated air flow to an area. Portable space heaters have achieved widespread commercial success because of their ability to provide supplemental heated air flow to an area. Unfortunately, the layout and décor of a living room or bedroom typically does not facilitate the use of portable space heaters. For example, in a conventional living room area containing a couch, end table and a coffee table, a portable space heater could be placed on the end table or coffee table to direct its heated air flow toward the person or persons seated on the couch. Yet, such placement of the heated space heater would detract from the décor of the living room. As another alternative, placement of the portable space heater on the floor could potentially create a fire hazard if located too close to the couch and would otherwise create a hazard blocking ingress and egress to the couch, potentially resulting in a person tripping over the portable space heater.

Representative patents comprising portable space heaters and lamps are reflected in the following U.S. patents, the disclosures of which are hereby incorporated by reference herein.

| U.S. Pat. No. | TITLE |
|---|---|
| 6,304,719 | Radiant Heater With Halogen Lamp |
| 6,089,726 | Lamp Shade Heater Device |
| 5,511,145 | Portable Electric Heater or Floor Lamp |

Therefore, it is an object of this invention to provide an improvement which overcomes the aforementioned inadequacies of the prior art devices and provides an improvement which is a significant contribution to the advancement of the portable space heater and lamp art.

Another object of this invention is to provide a portable space heater combined with a lamp which may be positioned onto an end table, a coffee table, a nightstand, or the like and provide illumination to the surrounding area as well as heated air flow.

Another object of this invention is to provide a floor lamp including a heater for supplying illumination to the surrounding area as well as heated air flow.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an integrated lamp and heater assembly. In one embodiment, the integrated lamp and heater assembly comprises a tabletop model intended to be positioned on a table, such as an end table, coffee table, nightstand, or the like. In another embodiment, the integrated lamp and heater comprises a free-standing floor model intended to be positioned on the floor proximate to a chair, a bed or other area that is desirous of being illuminated and being provided with a supplemental flow of heated air.

In both embodiments, the integrated lamp and heater assembly of the invention comprises a lower housing containing the heater assembly and an upper lamp assembly containing the lamp, both interconnected by an elongated neck—the length of which determines whether the integrated lamp and heater assembly comprises a table-top model or a floor model. Electrical switches are provided for independent control of the illumination intensity of the lamp and the temperature and rate of air flow of the heater.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 2A is a front view of the table-top embodiment showing a generally rectangular base;

FIG. 2B is a rear view of the table-top embodiment; and

Similar reference characters refer to similar parts throughout the several views of the drawings.

DETAILED DESCRIPTION OF THE PREFERRED EMBODIMENT

Figure 1A:
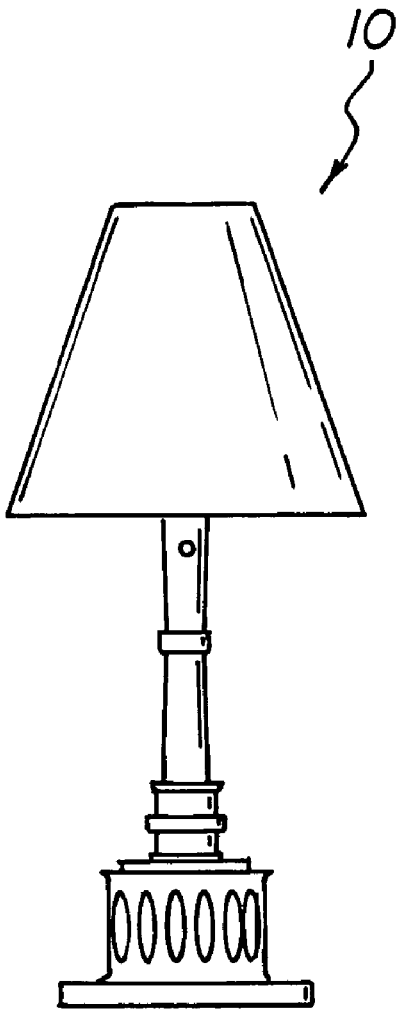
FIG. 1A is a front view of a table-top embodiment of the integrated lamp and heater assembly of the invention showing a generally-round base.
Figure 1B:
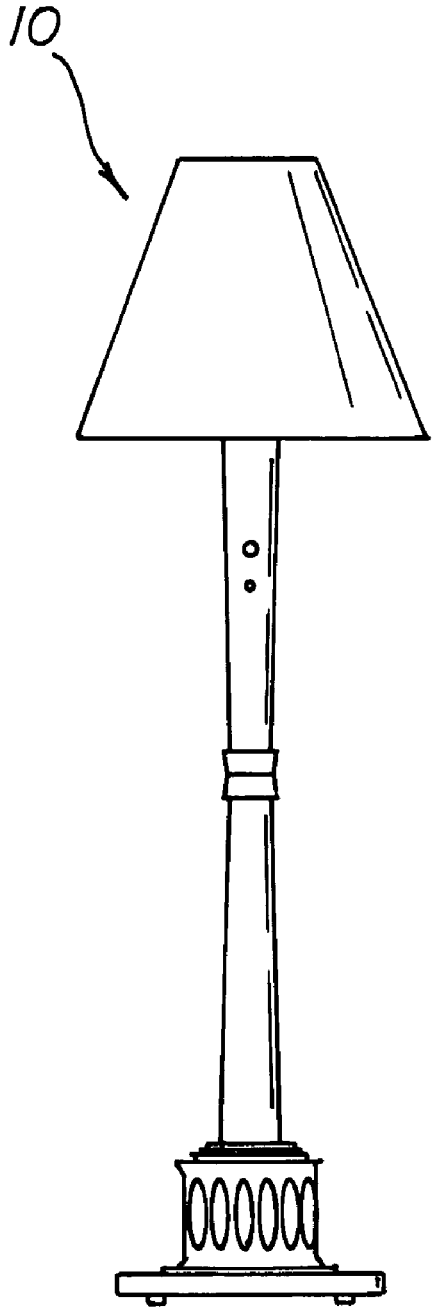
FIG. 1B is a front view of a floor embodiment of the integrated lamp and heater assembly of the invention.

The integrated lamp and heater assembly 10 of the invention comprises in one embodiment, a table-top model as shown in FIG. 1A and, in another embodiment, a floor model as shown in FIG. 1B. In both embodiments, the integrated lamp and heater assembly 10 of the invention comprises a lamp assembly 12 having a conventional incandescent or fluorescent lamp fixture 12F for receiving an incandescent or fluorescent lamp 12L and a heater assembly 14, interconnected by an upstanding elongated neck 16.

The elongated neck 16 may comprise a shorter length as shown in FIG. 1A for use as a table-top integrated lamp and heater assembly 10 that is intended to be placed on a table such as an end table, coffee table, nightstand, or the like. The elongated neck 16 may alternatively comprise a longer length, such as shown in FIG. 1B, intended to be placed onto the floor and consequently employed as a floor integrated lamp and heater assembly 10.

The table-top or floor embodiments of FIGS. 1A and 1B are intended to be positioned onto the table or floor proximate to the area to be illuminated and heated.

For example, the table-top embodiment of FIG. 1A may be placed onto a night table adjacent a bed to provide illumination and heat to a person lying in the bed and reading a book or a magazine. The heat produced by the heater assembly 14 provides increased comfort to the person while reading and/or trying to go to sleep, thereby allowing the thermostat of the home heater to be reduced without compromising the person's comfort.

Similarly, the floor model of the integrated lamp and heater assembly 10 of FIG. 1B may be conveniently placed adjacent to an easy chair to provide illumination and supplemental heat to the space about the easy chair. Indeed, in the embodiments of FIGS. 1A and 1B, the heater assembly 14 is located at the lower portion of the integrated lamp and heater assembly 10 such that, during use, the heated air flow therefrom rises to fully envelope the surrounding space.

The embodiment of FIGS. 1A and 1B comprise a lower housing 22 containing the heater assembly 14 including a generally circular configuration. However, referring to FIGS. 2A and 2B, the housing 22 of the heater assembly 14 may alternatively comprise a generally rectangular configuration. Whether generally circular as shown in FIGS. 1A and 1B or rectangular as shown in FIGS. 2A and 2B, the front of the housing 22 comprises one or more openings 18 from which the heated air flow is delivered. Similarly, whether of a generally circular configuration as shown in FIGS. 1A and 1B or a generally rectangular configuration as shown in FIGS. 2A and 2B, the rear of the housing 22 comprises one or more intake vents 20 into which air may be drawn into the housing 22 to be heated by the heater assembly 14 and directed out of the opening 18. It is noted that due to the portable nature of the integrated lamp and heater assembly 10 of the invention, the air flow flowing from the opening 18 may be aimed directly toward the individual for maximum comfort by simply turning the integrated lamp and heater assembly 10 to aim the openings 18 toward such individual.

Figure 3:
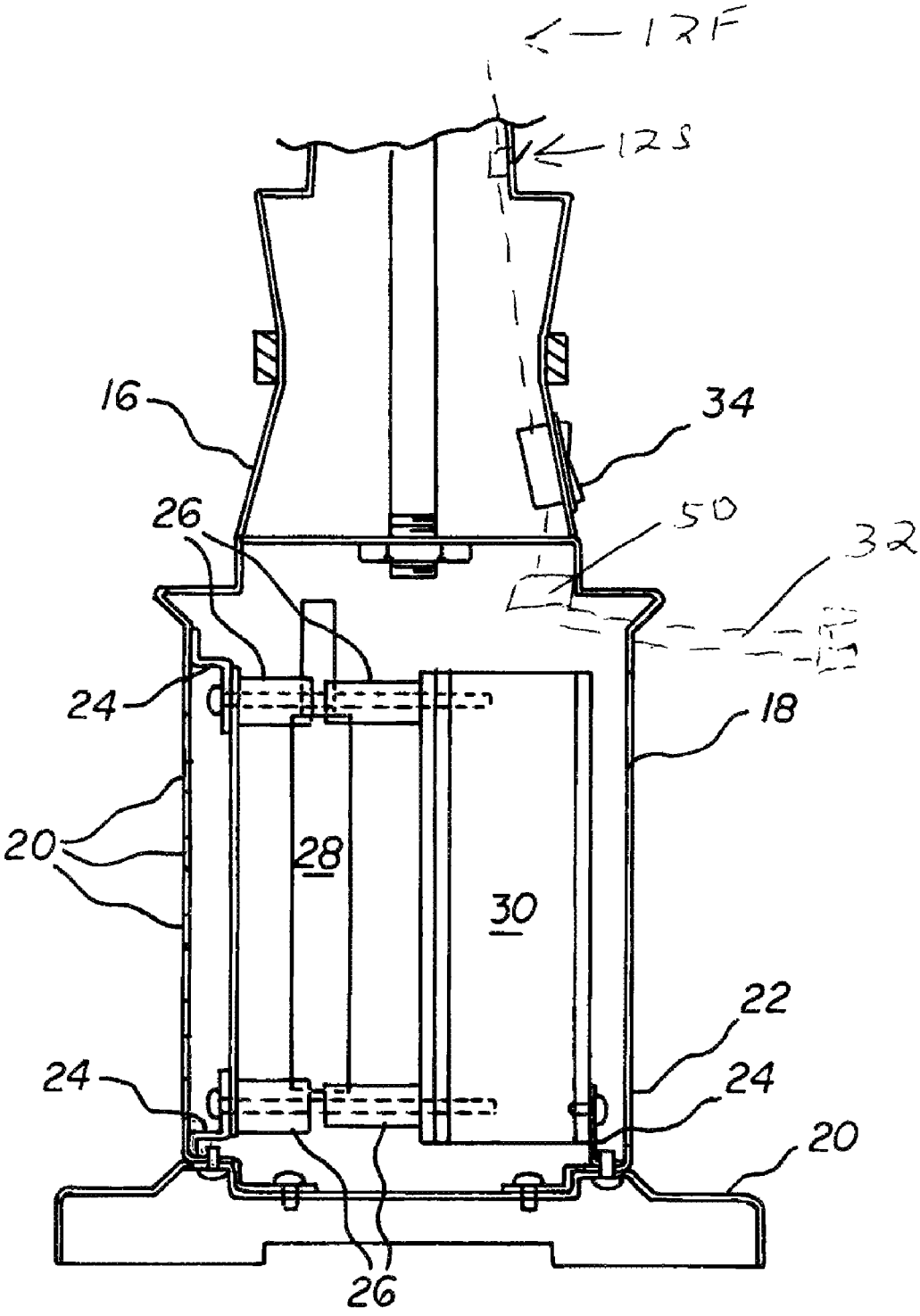
FIG. 3 is a partial, cut-away view of the housing containing the heater.

Referring to FIG. 3, the housing 22 comprises a base 20 for positioning on the table or floor, depending on the model. The elongated neck 16 is connected to the upper end of the housing 22 to extend upwardly therefrom. The elongated neck 16 interconnecting the lamp assembly 12 with the housing 22, may comprise any desired decorative shape or color without departing from the spirit and scope of this invention. For example, the elongated neck 16 may comprise bulbous or scalloped decorative configurations as may be desired.

The heater assembly 14 further comprises a framework, generally indicated by numeral 24, which supports via standoffs 26 a heating element 28 and an axial blower fan 30 in a spaced-apart, stacked configuration in alignment with each other and in alignment with the intake vents 20 and the openings 18. The heating element 28 preferably comprises a positive temperature coefficient (PTC) heating element comprised of one or more small ceramic stones with self temperature limiting characteristics. PTC stones have fast heating response times and plateau once a pre-defined reference temperature is reached. The shape of these stones may be square, rectangular, round, ring or doughnut style. Above the reference temperature, the semiconducting and ferro-electrical properties of the ceramic are utilized to produce a rise in resistance of several orders of magnitude, and hence produce its self limiting properties. This resistance rise can be experienced over a temperature range of a few degrees Celsius. The attributes of PTC achieves a heating element that self-regulates at a pre-set temperature and automatically varies its wattage in order to maintain that pre-set temperature. Hence, a greater degree of thermal dissipation (cooling) will result in higher power. The materials commonly used are doped polycrystalline ceramics based on barium titanate. Once the ceramic body has been formed through processes including blending, milling, drying and sintering, metallized contacts are applied to the surface to facilitate electrical connection.

Electrical power from a conventional electrical cord 32 is supplied through a switch 34 to the PTC heating element 28 and to the axial blower 30 to electrically power the same. While many operating conditions may be configured depending on the type of switch, in a preferred embodiment of the invention, switch 34 comprises a toggle switch having a "high" position supplying a high amount of electrical power to the PTC heating element 28 and to the axial blower 30 to operate, for example, at a high speed setting operating at 1000 watts and a "low" position supplying a low amount of electrical power to the PTC heating element 28 and to the axial blower 30 to operate, for example, at a low speed setting operating at 800 watts.

Electrical power from the electrical cord 32 is likewise supplied by wiring extending up through the elongated neck 16 to the conventional light fixture 12F and through a conventional light switch 12S. The wiring of the lamp fixture 12F may, for example, comprise a three-way lamp switch 12S for powering a conventional three-way light bulb.

Without departing from the spirit and scope of this invention, the integrated lamp and heater assembly 10 of the invention may comprise a "tip-over" switch 50, such as a mercury switch, that automatically interrupts electrical power to the heater assembly 14 in the event of a tip over. The light assembly 12 and/or the heater assembly 14 may be provided with timers to automatically turn on or turn off the light and/or the heater after a certain delay (e.g., after thirty minutes when the person would likely have fallen asleep) and/or at a certain time of day (e.g., at 6:00 a.m. when the person is expected to awake).

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An integrated lamp and heater assembly, comprising in combination:

a lamp assembly;

a housing having a top end and an enlarged lower base that is adapted to be placed on a table or a floor surface, the housing having a vertical side walls with a plurality of vents through opposite facing portions of the vertical side walls, the housing having a diameter between opposite surfaces of the vertical side walls;

a heater assembly mounted inside of the housing, the heater assembly having a blower fan adjacent to an interior surface of one of the vertical side walls, the heater assembly having a heating element adjacent to an opposite interior surface of the vertical side walls; and an upstanding vertically oriented elongated neck having a lower end attached to the top end of the housing, and an upper end attached to said lamp assembly, the elongated neck having a smaller diameter than the diameter of the housing.

2. The integrated lamp and heater assembly as set forth in claim 1, wherein said elongated neck comprises a shorter length for use as a table-top integrated lamp and heater assembly.

3. The integrated lamp and heater assembly as set forth in claim 1, wherein said elongated neck comprises a longer length for use as a floor integrated lamp and heater assembly.

4. The integrated lamp and heater assembly as set forth in claim 1, wherein said heater assembly comprises in combination:

a framework connected within said housing to which is mounted the heating element and the blower fan in a stacked configuration with each other and in alignment with an intake vent.

5. The integrated lamp and heater assembly as set forth in claim 4, wherein said housing comprises:

a plurality of stand offs for separating the heating element from the blower fan.

6. The integrated lamp and heater assembly as set forth in claim 1, wherein the heating element comprises:

a plurality of positive temperature coefficient(PTC) ceramic stones.

7. The integrated lamp and heater assembly as set forth in claim 6, wherein the PTC ceramic stones comprise:

doped polycrystalline ceramics based on barium titanate.

8. The integrated lamp and heater assembly as set forth in claim 1, further comprising:

a tip-over switch attached to the heater assembly, the tip-over switch for automatically interrupting electrical power to the heater assembly when the integrated lamp and heater assembly is being tipped over.

9. The integrated lamp and heater assembly as set forth in claim 6, further comprising:

a switch for supplying electrical power to the heating element and the blower fan, the switch having a high position for supplying a high amount of power to the PTC ceramic stones, the switch having a low position for supplying a lower amount of power to the PTC ceramic stones, the high position being at a higher amount of watts than the low position.

10. An integrated lamp and heater assembly, comprising in combination:

a lamp assembly;

a housing having a top end and an enlarged lower base that is adapted to be placed on a table or a floor surface, the housing having a vertical side walls with a plurality of vents through the vertical side walls, the housing having a diameter between opposite surfaces of the vertical side walls;

a heater assembly mounted inside of the housing, the heater assembly having a blower fan adjacent to an interior surface of one of the vertical side walls, the heater assembly having a heating element adjacent to an opposite interior surface of the vertical side walls, the heating element includes a plurality of positive temperature coefficient(PTC) ceramic stones;

a framework connected within said housing to which is mounted the heating element and the blower fan in a stacked configuration with each other and in alignment with an intake vent;

a plurality of stand offs for separating the heating element from the blower fan;

an upstanding vertically oriented elongated neck having a lower end attached to the top end of the housing, and an upper end attached to said lamp assembly, the elongated neck having a smaller diameter than the diameter of the housing; and a tip-over switch attached to the heater assembly, the tip-over switch for automatically interrupting electrical power to the heater assembly when the integrated lamp and heater assembly is being tipped over.

11. The integrated lamp and heater assembly as set forth in claim 10, wherein the PTC ceramic stones comprise:

doped polycrystalline ceramics based on barium titanate.

12. The integrated lamp and heater assembly as set forth in claim 10, further comprising:

a switch for supplying electrical power to the heating element and the blower fan, the switch having a high position for supplying a high amount of power to the PTC ceramic stones, the switch having a low position for supplying a lower amount of power to the PTC ceramic stones, the high position being at a higher amount of watts than the low position.

* * * * *